United States Patent [19]

Saether et al.

[11] 4,385,751

[45] May 31, 1983

[54] APPARATUS FOR DISCONTINUOUS CHARGING OF MOLTEN METAL INTO A VACUUM CHAMBER

[75] Inventors: Torstein Saether, Sunndalsora; Bjarne Heggset, Frei, both of Norway

[73] Assignee: Ardal og Sunndal Verk A/S, Oslo, Norway

[21] Appl. No.: 307,363

[22] Filed: Sep. 30, 1981

[30] Foreign Application Priority Data

Jun. 30, 1980 [NO] Norway ..... 801956

[51] Int. Cl.[3] ..... C21D 7/10

[52] U.S. Cl. ..... 266/207; 266/236; 266/240; 222/598; 75/46

[58] Field of Search ..... 266/207, 236, 240; 222/598, 599; 164/337, 256, 258

[56] References Cited

U.S. PATENT DOCUMENTS

| | | | |
|---|---|---|---|
| 998,787 | 7/1925 | Löhe | 266/240 |
| 2,193,034 | 3/1940 | Mars | 164/258 |
| 3,139,472 | 6/1964 | Evans | 214/36 |

FOREIGN PATENT DOCUMENTS

| | | | |
|---|---|---|---|
| 643736 | 6/1962 | Canada | 164/258 |
| 1069340 | 11/1959 | Fed. Rep. of Germany . | |
| 127712 | 8/1973 | Norway . | |
| 7215098 | 5/1977 | Sweden . | |
| 734295 | 1/1978 | U.S.S.R. | 266/207 |

*Primary Examiner*—L. Dewayne Rutledge
*Assistant Examiner*—Christopher W. Brody
*Attorney, Agent, or Firm*—Wenderoth, Lind & Ponack

[57] ABSTRACT

A device for the discontinuous charging of molten metal into a vacuum chamber which is continuously held under vacuum includes a charging vessel or tundish on which is disposed a fixed transfer pipe so positioned that the tundish can be rotated about the axis of the pipe to such an extent that the pipe's input orifice is lifted above the surface of the metal flow in the tundish, while at the same time the pipe is withdrawn from the vacuum chamber. The chamber is sealed with a plate valve.

3 Claims, 3 Drawing Figures

APPARATUS FOR DISCONTINUOUS CHARGING OF MOLTEN METAL INTO A VACUUM CHAMBER

BACKGROUND OF THE INVENTION

This invention is of significance in the treating of molten metal in the aluminum industry, with particular reference to the transferring of molten pot metal to furnaces or chambers from which the air has been evacuated.

The purpose of the present invention is to provide the equipment required for performing this operation.

The electrolytic reduction of alumina to aluminum takes place in large electrolytic reduction cells, or pots, at a temperature of about 970° C., and with production per 24 hours of around 1 ton. A potroom contains between 100 and 180 such pots. The chemical composition varies somewhat from one pot to another, and for this reason the metal taken from several pots is mixed in order to arrive at the composition required for the finished product.

The metal is tapped from the pots by a tube which is immersed into the metal, the other end of which tube is fixed into the top of a tapping crucible. For tapping, the air is evacuated from this crucible and the metal is sucked up. The metal is then conveyed, in the tapping crucible, to a mixer furnace.

It has been usual practice to use one mixer to serve two casting furnaces. In the casting furnace, the metal can be cleaned in various manners before pouring. The furnace can be put under vacuum in order to allow gas to escape while the metal stands undisturbed for the required period. The vacuum treatment can be made more efficient by allowing the metal to be sucked into the furnace. The metal entering the furnace in the form of a jet exposes a large and ever-changing surface of the metal. The diameter of the jet is small, favouring a rapid liberation of gases. The vacuum treatment can also be enhanced by introducing inert gases down into the metal while the furnace is under vacuum. The vacuum treatment of metal through its being sucked into a vacuum furnace is very efficient, but has hitherto required that the metal be added continuously from a mixer. It has not been possible in practice to seal the charge hole when the furnace is in use and under vacuum.

SUMMARY OF THE INVENTION

The present invention makes it possible to seal the charge hole of a vacuum furnace while it is under vacuum, and thereby to add metal discontinuously.

The basic principle of the invention is that the metal is transferred to the vacuum furnace via a rotatable charging vessel, or tundish, which has a transfer pipe near the bottom, this tundish also being movable in the direction of the transfer pipe's axis in such a manner that, during metal transfer, the exit orifice of the pipe is inside the vacuum furnace, while, in the closed condition, the pipe is withdrawn from the vacuum furnace. The vacuum furnace is then sealed by means of a flap, or plate, while the entrance orifice of the transfer pipe is above the surface of the metal in the tundish, because the latter has been rotated downwards about the axis of the transfer pipe.

BRIEF DESCRIPTION OF THE DRAWINGS

The invention will be described in more detail below with reference to the accompanying drawings, wherein.

DETAILED DESCRIPTION OF THE INVENTION

Figure 1:
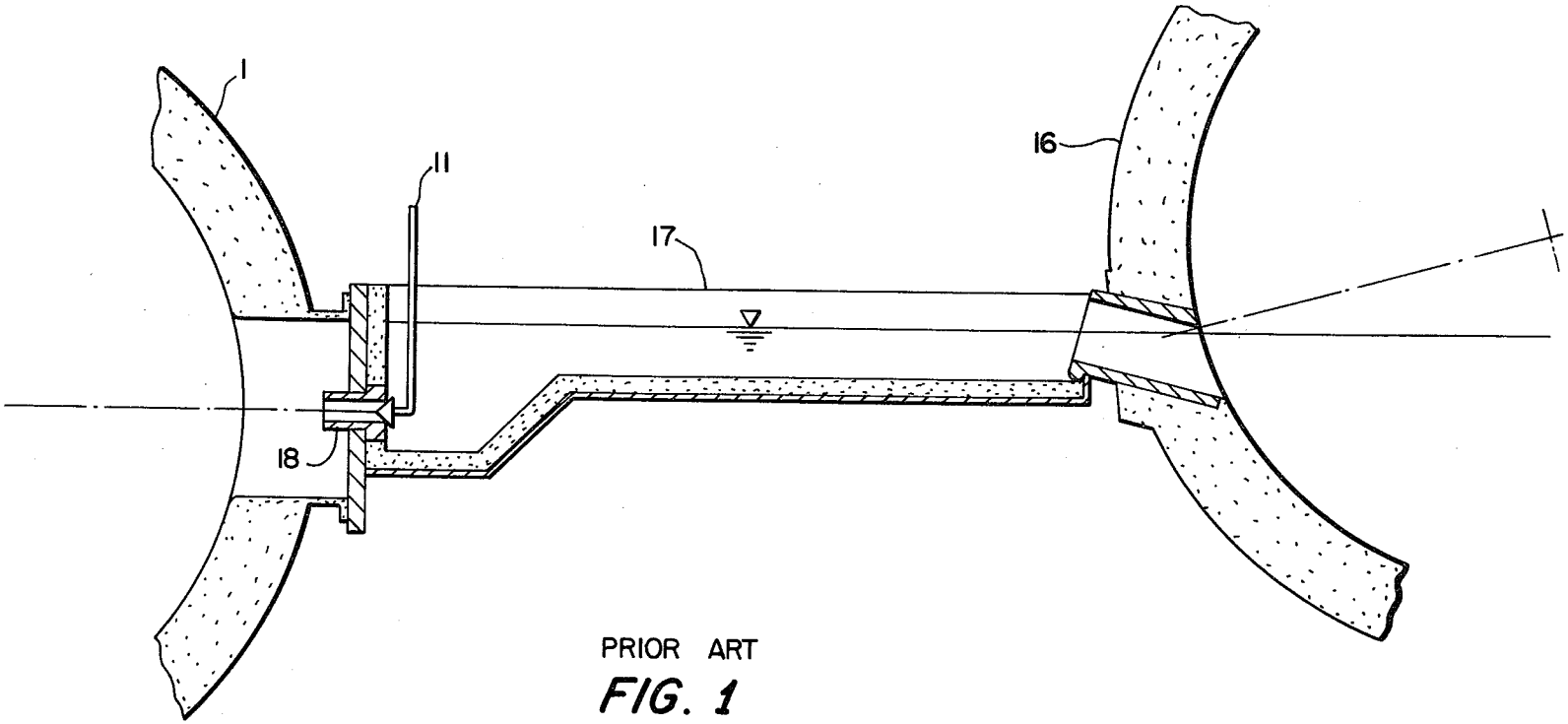
PRIOR ART FIG. 1
FIG. 1 is a partial section illustrating a conventional apparatus for transferring molten metal from a mixer to a vacuum furnace.

FIG. 1 illustrates a conventional arrangement including a vacuum furnace 1 and a mixer 16. The mixer has been raised to a high position, and tilted in order to transfer metal to a launder, or trough 17. A charge hole 18 in the vacuum furnace is sealed against metal entry by plug 11. Plug 11 remains in position while furnace 1 is evacuated before metal transfer starts. Once metal has started to flow into the furnace, it has proved impossible in practice to close the furnace again with a vacuum-tight seal.

Figure 2A:
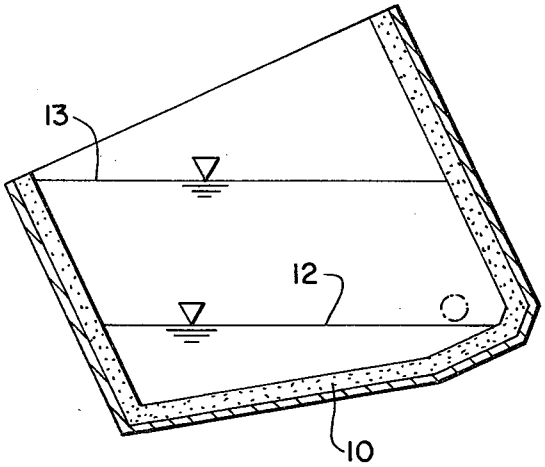
FIG. 2*a* is a section taken along line II*a*—II*a* in FIG. 2.
Figure 2:
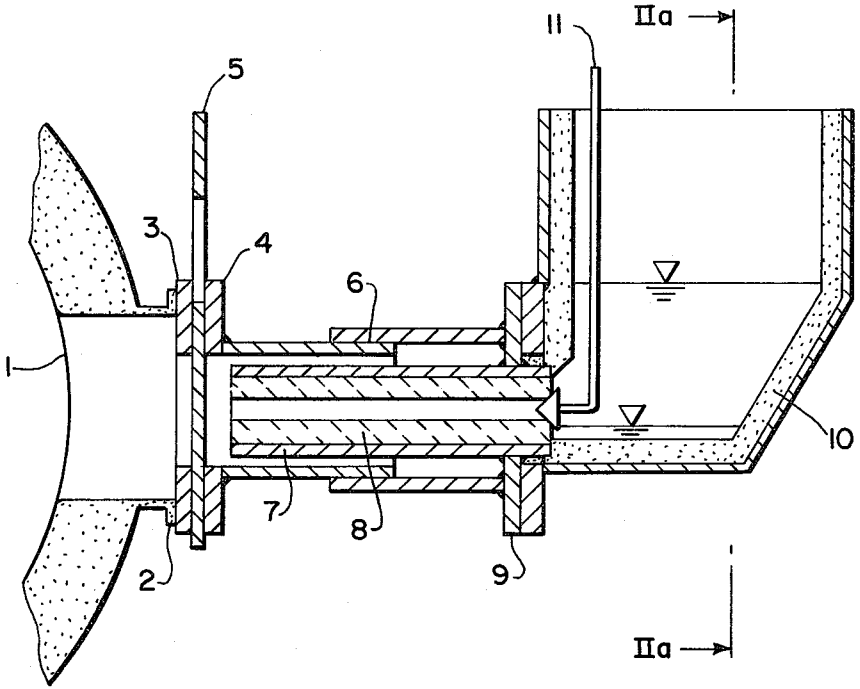
FIG. 2 is a partial section of an apparatus according to the present invention, showing a charging vessel or tundish fitted onto a furnace and in a closed position.

FIGS. 2 and 2*a* illustrate an apparatus according to the invention, also including vacuum furnace 1. Bolted onto a flange 2 of furnace 1 is a flange 3 which forms part of a coupling between the vacuum furnace 1 and a tundish 10. Between the outer flange 3 and an inner flange 4 there is a sliding plate 5 which can form a vacuum-tight seal against the opening to the vacuum furnace 1.

To the inner flange 4, is welded a tubular connecting piece 6 into which extends a transfer pipe 7, also called nozzle guide, with a refractory lining 8, which also is often called a nozzle because it helps to form a metal jet into the vacuum furnace. The transfer pipe 7 is welded onto a flange 9 of the tundish 10.

The tundish 10 can be rotated about the axis of the transfer pipe, and can also be moved axially thereof, so that pipe 7 can be fully withdrawn from the vacuum furnace 1 and past the sliding plate 5, as shown in FIG. 2. In FIG. 3, the transfer pipe 7 has been inserted into the vacuum furnace 1.

When the tundish 10 is rotated about the pipe 7, the surface of the metal in tundish 10 can be lowered to a level such that it lies below the transfer pipe 7 thus preventing the conveying of any more metal 13 shows a metal height when transfer can take place. Plug 11 in FIG. 2 is used in the same manner as in FIG. 1, except before metal transfer starts.

Figure 3A:
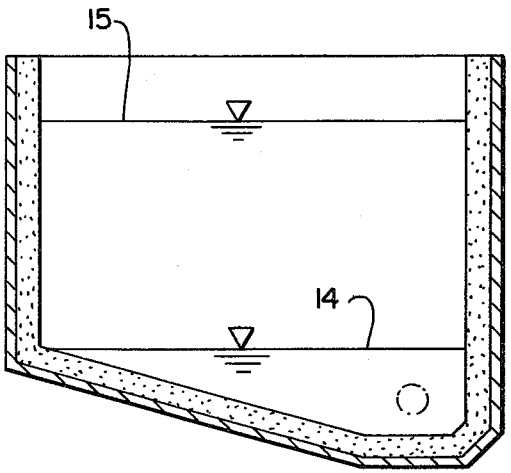
FIG. 3*a* is a section taken along line III*a*—III*a* in FIG. 3.
Figure 3:
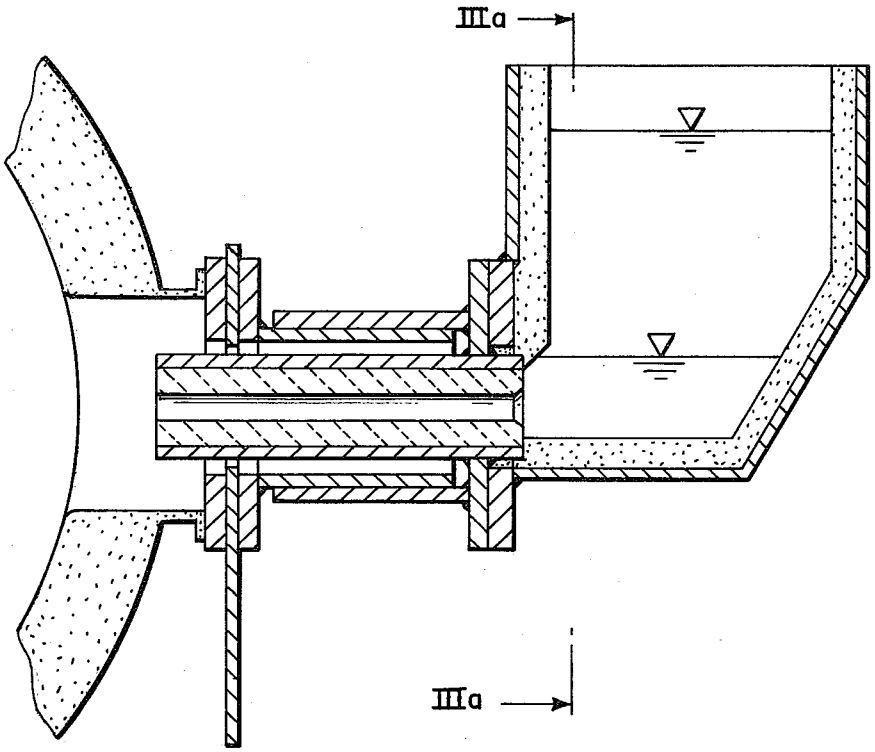
FIG. 3 is a view similar to FIG. 2, but with the apparatus shown in the open position.

In FIGS. 3 and 3*a* the tundish is in correct position for metal transfer. The surface of the metal must lie between positions 14 and 15.

In the following, the operation of the apparatus of the invention will be described.

FIG. 1, as previously mentioned, illustrates the conventional method of transferring molten aluminum from a mixer furnace 16 to a vacuum furnace 1.

Plug 11 seals the charge hole. (It is usual practice to apply some sealing agent to the plug 11, as this alone does not provide a good enough seal. This is a simple matter because at that stage there is no metal in the launder).

The vacuum furnace 1 is evacuated.

The metal is poured into the transfer launder 17.

When the metal has reached the height shown in FIG. 1, plug 11 is removed.

When the required quantity of metal has been transferred, the vacuum has to be opened to the atmosphere. As already mentioned, a sealing device such as the plug 11 is not good enough alone to provide a vacuum-tight seal against the atmosphere after charging/transfer. This method has therefore the following weaknesses.

It requires a continuous flow of metal for rational operation. In other words, a mixer furnace is necessary. The method is therefore not suitable for automation/rationalization, with respect to discontinuous charging (for example charging from crucibles). The result is dependent upon the skill of the operator, with particular reference to sealing the charge hole. There is no possibility of continuous vacuum treatment after metal transfer. The process is laborious.

When metal transfer is to be effected in accordance with the invention, the process is started, as shown in FIG. 2*a*, with the tundish 10 swung down to its lower position.

Charging

To start a charging procedure, plate 5 is slid into its open position (FIG. 3).

Nozzle 8 and its housing, transfer pipe 7, and the tundish 10 are moved axially towards the vacuum furnace 1, so that the exit orifice of the nozzle enters the vacuum chamber 1 in the position ready for delivering metal (FIG. 3).

Metal is poured into the tundish 10 up to a level between 12 and 13. See FIG. 2*a*.

The tundish 10 is swung up. See FIG. 3*a*.

Simultaneously with the removal of the plug 11, more molten metal is poured into the tundish. Charging is in progress, and the emptying of the molten metal in the tundish 10 is so arranged that the metal level is kept between 14 and 15.

Stopping charging

At the lowest possible metal level 14 in the tundish 10, the plug 11 is put back into the input orifice of the transfer pipe 8. The tundish 10 is then swung down to bring the metal surface 12 below this input orifice. Nozzle 8, the transfer pipe 7 and the tundish 10 are withdrawn bringing the exit orifice of the transfer pipe behind the sliding plate 5. Plate 5 is returned to the closed position, providing an efficient seal between the vacuum furnace and the atmosphere.

All of these movements are performed by hydraulics or pneumatics. The actions can be controlled automatically by, for example, sequence control.

This invention permits the rational charging of a vacuum furnace direct from tapping crucibles without losing the vacuum in the furnace between each charge, thus obviating the need for a mixer furnace. It provides an efficient seal against the atmosphere as the invention, to a large extent, is independent of a good seal between the plug and the input orifice. Vacuum treatment of the metal can continue unbroken following the charging of the vacuum furnace. The entire charging process can be automated.

The invention has been described for transferring molten aluminum to a vacuum furnace, but it will be understood that it is equally applicable to the transferring of all liquid metals to a vacuum chamber.

We claim:

1. An apparataus for transferring molten metal into a vacuum chamber, said apparatus comprising:

a valve adapted to be mounted on the vacuum chamber for movement between a closed position blocking an inlet to the vacuum chamber and an opened position unblocking the inlet;

a tundish adapted to receive molten metal;

a transfer pipe fixed to a bottom portion of said tundish, said transfer pipe having an input orifice opening into the interior of said tundish and an exit orifice; and guide means, adapted to be fixed to the vacuum chamber, for mounting said transfer pipe and said tundish to permit rotational movement of said transfer pipe and said tundish about the axis of said transfer pipe, such that said input orifice may be moved between positions above and below the surface of the molten metal in said tundish, and to permit axial movement of said transfer pipe and said tundish between a molten metal delivery position, whereat said exit orifice extends through said valve, when in said opened position thereof, and into the vacuum chamber, and a position whereat said exit orifice is withdrawn to the exterior of said valve.

2. An apparatus as claimed in claim 1, wherein said valve comprises a plate member having therethrough an opening adapted to be aligned with the vacuum chamber inlet when said valve is in said opened position thereof.

3. An apparatus as claimed in claim 1, further comprising plug means insertable into said tundish for selectively blocking said input orifice.

* * * * *